US011432600B1

(12) United States Patent
Van Sant

(10) Patent No.: US 11,432,600 B1
(45) Date of Patent: Sep. 6, 2022

(54) FINGER PROTECTOR APPARATUS AND RELATED METHODS

(71) Applicant: William Craig Van Sant, Chino Hills, CA (US)

(72) Inventor: William Craig Van Sant, Chino Hills, CA (US)

( * ) Notice: Subject to any disclaimer, the term of this patent is extended or adjusted under 35 U.S.C. 154(b) by 0 days.

(21) Appl. No.: 17/035,034

(22) Filed: Sep. 28, 2020

(51) Int. Cl.
*A41D 13/08* (2006.01)

(52) U.S. Cl.
CPC ..... *A41D 13/087* (2013.01)

(58) Field of Classification Search
CPC ..... A41D 13/087; A41D 2400/80
USPC ..... 2/21
See application file for complete search history.

(56) References Cited

U.S. PATENT DOCUMENTS 1,380,960 A * 6/1921 Hmenia ..... D05B 91/04 223/101
2,701,878 A * 2/1955 Davis ..... A61F 13/105 2/21
2,717,799 A * 9/1955 Jones ..... A41D 13/087 294/25
3,902,509 A * 9/1975 Tundermann ..... A46B 5/04 206/229
6,244,177 B1 * 6/2001 Young ..... B41K 1/50 101/333
9,723,879 B1 * 8/2017 Delgrosso ..... A41D 13/087
10,155,613 B1 * 12/2018 Bovis ..... A41D 27/08
2002/0170133 A1 * 11/2002 McDevitt ..... B32B 27/12 15/104.94
2008/0005822 A1 * 1/2008 Lavner ..... A41D 13/087 2/21
2012/0222186 A1 * 9/2012 Vena ..... A41D 13/087 2/21
2014/0028039 A1 * 1/2014 Rampersad ..... A61F 13/105 294/99.2
2014/0078118 A1 * 3/2014 Robb ..... A41D 19/0024 345/179

(Continued)

OTHER PUBLICATIONS

"Choice Medium Disposable Food Service Poly Gloves", screenshot from https://www.webstaurantstore.com/choice-medium-disposable-food-service-poly-gloves-case/682DISPM.html.

(Continued)

*Primary Examiner* — Tajash D Patel
(74) *Attorney, Agent, or Firm* — J. Mark Holland & Associates; J. Mark Holland; Alison Adnan

(57) ABSTRACT

Apparatus and methods are disclosed for preventing and protecting a user from disease and virus transmission that might otherwise occur from contacting or touching potentially contaminated surfaces. A finger protector provides a barrier between a user's finger and a potentially contaminated surface when a user makes contact with or touches the surface. Indicia on the protector provide visual and/or physical indicators to enable a user to track the potentially contaminated and non-contaminated surfaces of the finger protector, before, during, and after use. This enables a user to safely grab the non-contaminated portion of the protector for removal from their finger after use, thereby further helping reduce the risk of contamination and potential disease and virus transmission. The disclosed methods and apparatus include for use, fabrication, packaging, and distribution of the protectors.

6 Claims, 9 Drawing Sheets

(56) References Cited

U.S. PATENT DOCUMENTS

| | | | | |
|---|---|---|---|---|
| 2014/0331377 | A1* | 11/2014 | Taylor-Lopez | A41D 13/087 2/21 |
| 2019/0142192 | A1* | 5/2019 | Rampersd | A47G 21/001 294/99.2 |

OTHER PUBLICATIONS

"Cowhide Cow Leather Finger Cots Cover Sleeves for fingers Protection", screenshot from https://www.ebay.com/p/2170229035.
"Finger Guard—Over End Style", screenshot from https://www.ebay.com/p/2170229035.
"Natural Rubber Latex Powder Free Finger Cots", screenshot from https://www.grainger.com/product/30D251.
"Jrery-KEY Finger Protectors Finger Caps", screenshot from https://www.amazon.com/Jrery-KEY-Protectors-Silicone-Fingertips-Protection/dp/B07ZVX4JXM.
"Swingline Finger Tips", screenshot from https://www.staples.com/swingline-size-11-5-medium-finger-pads-yellow-dozen-54035/product_SWI54035.
"Latex Finger Cots", screenshot from https://www.gesswein.com/p-11304-latex-finger-cots-pink-1-gross-bags.aspx.
"Latex Fingertips Protective Giove Finger Cots", screenshot from https://www.wish.com/product/5ae8843ab9f58b2bc8f18f51.
"Nitrile Finger Cots", screenshot from https://www.uline.com/Product/Detail/S-15365M/Finger-Cots/Tape/Nitrile-Finger-Cots-Powder-Free-Medium.

* cited by examiner

Mean finger lengths and palm dimensions of USAF male (M)/female (F) flying personnel [9, 10] (cm).

| | Finger length (crotch to tip) | | | | Finger length (wrist crease to tip) | | | |
|---|---|---|---|---|---|---|---|---|
| | Mean | s.d. | <5% | <95% | Mean | s.d. | <5% | <95% |
| M | | | | | | | | |
| Thumb | 5.87 | 0.45 | 5.07 | 6.57 | 12.70 | 1.13 | 11.05 | 14.68 |
| Index | 7.53 | 0.46 | 6.83 | 8.19 | 18.52 | 0.88 | 17.33 | 20.06 |
| Middle | 8.57 | 0.51 | 7.82 | 9.74 | 19.52 | 0.92 | 18.10 | 21.04 |
| Ring | 8.0 | 0.47 | 7.44 | 8.93 | 18.72 | 0.91 | 17.52 | 20.28 |
| Little | 6.14 | 0.47 | 5.44 | 6.99 | 16.61 | 0.91 | 15.11 | 18.10 |
| F | | | | | | | | |
| Thumb | 5.37 | 0.44 | 4.68 | 6.12 | 11.05 | 1.00 | 9.51 | 12.83 |
| Index | 6.90 | 0.52 | 6.10 | 7.80 | 16.67 | 0.89 | 15.21 | 18.14 |
| Middle | 7.79 | 0.51 | 7.01 | 8.68 | 17.65 | 0.87 | 16.22 | 19.05 |
| Ring | 7.31 | 0.52 | 6.52 | 8.22 | 16.76 | 8.94 | 15.28 | 18.20 |
| Little | 5.46 | 0.44 | 4.80 | 6.24 | 14.64 | 0.92 | 13.11 | 16.12 |

[Chen, Fai Chen, et al. "Constraint study for a hand exoskeleton: human hand kinematics and dynamics." Journal of Robotics, 2013. Gale Academic OneFile, Accessed 10 Sept. 2020.]

FIG. 11A

* The above data are measurements of flat pressure of the finger cots.

[from https://evridwearus.com/collections/all-products/products/whitepoly-finger-cots]

FINGER PROTECTOR APPARATUS AND RELATED METHODS

FIELD OF THE INVENTION

The present invention is directed to apparatus and methods for preventing and protecting a user of shared and/or commonly-used devices and objects from disease and virus transmission by contact with and/or touching of potentially contaminated surfaces.

The present invention is directed to a finger (or digit) protector which provides a barrier between a user's finger and a potentially contaminated surface when a user makes contact with or touches the surface. The present invention further provides visual and physical indicia for potentially contaminated and non-contaminated surfaces of the finger protector, so that a user can be aware of where to safely grab the protector for removal from their finger after use (to avoid contamination and potential disease and virus transmission). Although the inventions are generally illustrated in connection with being placed on a user's index finger, other embodiments (not shown) can be practiced for any of a user's digits (including the user's thumbs or toes).

BACKGROUND OF THE INVENTION

It is well known that diseases, viruses, bacterial infections, and germs may be transmitted not just through human-to-human contact, but also through contact with surfaces which may be contaminated with diseases, bacterial infections, viruses, or germs. Among other things, those surfaces may have been contaminated through prior contact with or exposure to persons who may be carrying, infected with and/or contagious with said diseases, infections, viruses, or germs. Certain diseases and viruses remain viable for hours to days on surfaces made from a variety of materials, including the novel Coronavirus, SARS-CoV-2, that causes coronavirus disease 2019 (COVID-19) [information on COVID-19 is available from the U.S. government CDC: Centers for Disease Control and Prevention; at https://www.cdc.gov/coronavirus/2019-ncov/prevent-getting-sick/cleaning-disinfection.html].

Accordingly, a need exists for protection from contact transmission of diseases, bacterial infections, and viruses to humans by way of contaminated surfaces. This risk of transmission can be especially large for surfaces and objects which are contacted and touched by many different people over a short period of time and/or which are frequently used.

Furthermore, a need exists for safe, sturdy, disposable, easy to use, readily available protectors which can allow users to avoid contact with potentially contaminated surfaces and objects (especially those mentioned above-surfaces and objects which are touched and contacted by many different people over a short period of time and/or which are frequently used).

The present inventions provide a safe, sturdy, disposable, easy to use, readily available finger protector which provides a barrier between (1) a finger or fingers which is interacting/contacting a potentially contaminated surface or object and (2) the surface. Certain embodiments of finger protectors of the present inventions protect against disease and virus transmission by providing a non-contaminated gripping portion that provides a user with a visual cue as to where to grasp the protector to safely remove it from a finger after use on a potentially contaminated surface.

The present invention is described herein with reference to the accompanying Figures, which serve as illustrations of some of the many embodiments in which the invention may be practiced. Subject to the context and other factors (including for example the understanding of persons of ordinary skill in the arts relevant to the inventions), generally in those Figures and references similar reference numerals refer to similar or identical elements throughout this description.

Those Figures and references, and the other terminology used in these descriptions, are not intended to be interpreted in any limited or restrictive manner, simply because they are being utilized in conjunction with a detailed description of certain embodiments of the invention. Furthermore, various embodiments of the invention (whether or not specifically described herein) may include one or more of the novel features disclosed herein, no single one of which (a) is necessarily solely responsible for any particular desirable attribute(s) of the inventions or (b) is essential to practicing the inventions described.

BRIEF DESCRIPTION OF THE DRAWINGS

FIG. 11A is a table listing mean finger lengths (in cm) for each finger and palm dimensions for males and females, as reported in a study in the 2013 Journal of Robotics.

DETAILED DESCRIPTION OF EMBODIMENTS

As indicated above, the inventions disclosed herein can be used in a broad range of applications and provide many benefits. As used herein, the term "protector" is intended to include, but is not limited to, a protective, prophylactic cover(ing), guard, cot, glove, pouch, pocket, sheath, or shield for protecting a human finger from disease and virus transmission through touch or contact of a surface or object which may be contaminated.

In preferred embodiments of the present invention, a protector is provided to fit and sufficiently cover a human finger. The protector or protectors may be provided in a variety of shapes and sizes to cover a range of finger sizes, including adult and child fingers. Although most applications may be designed for just one finger on a user's hand, other embodiments may accommodate multiple fingers.

Preferably, protectors of the present invention are sized to fit normal human fingers, although persons of ordinary skill in the art will understand that other sizes and shapes can be utilized. Similarly, although many or most applications may involve users' index fingers, protectors of the invention can be fabricated and provided and used or any finger on a human hand. In that regard, and as an example, protectors can be fabricated to accommodate fingers such as those described in a study in the 2013 Journal of Robotics, which reported the mean finger lengths (in cm) for each finger and palm dimensions for males and females as shown in FIG. 11A.

Figure 11B:
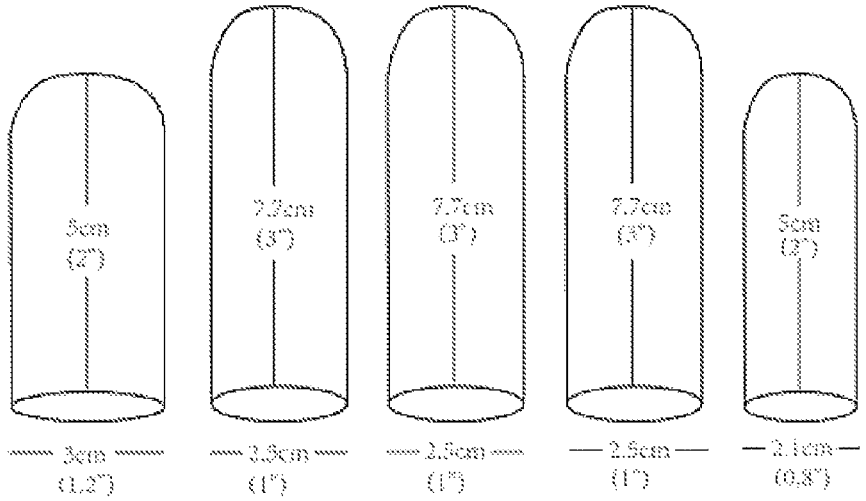
FIG. 11B is a diagram illustrating a sizing chart for prior art elastic finger cots.

For additional sizing reference, prior art elastic finger cots can be sized as shown in FIG. 11B for each finger on a human hand.

Preferably, the protectors of the present invention are sized to accommodate one or more fingers (normally not simultaneously) of an average-sized human hand according to the aforementioned sizing guidelines. In addition, the protectors preferably are easy to put on and remove, and have a gripping area that enables a user to grip an uncontaminated side of the protector with their unprotected/uncovered fingers. The gripping area/portion can be used to place and remove the protector from their protected finger, while enabling the user to avoid contacting other parts of the protector that may have become contaminated.

Figure 1:
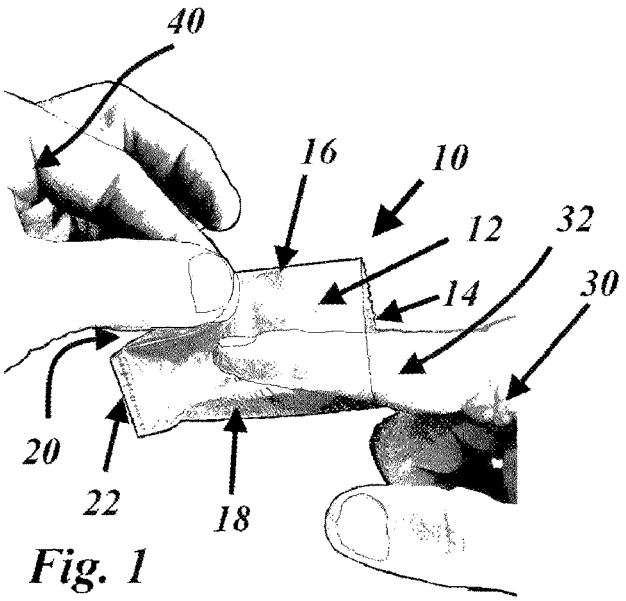
FIG. 1 is a preferred embodiment of the finger protector 10 of the present invention, illustrating a user's insertion and/or removal of a finger 32 into/from the protector 10.
Figure 2:
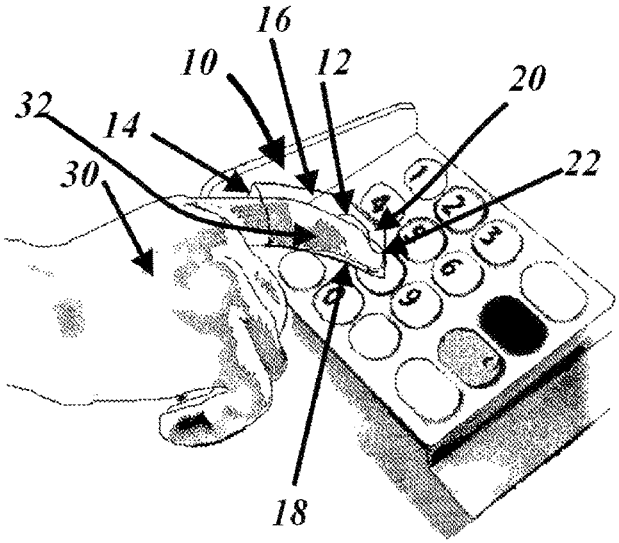
FIG. 2 illustrates a user manipulating a keypad device while wearing the protector 10 of FIG. 1, in a preferred embodiment of the present invention.
Figure 3:
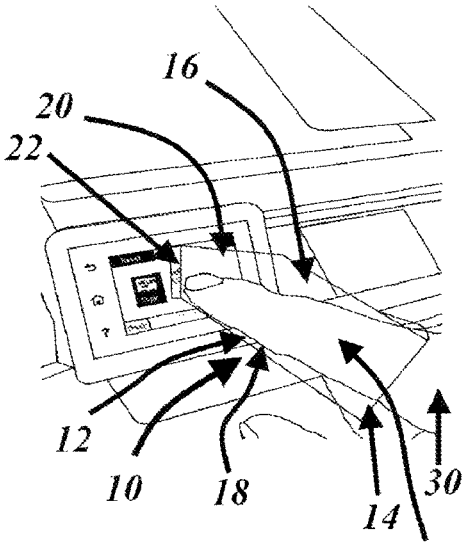
FIG. 3 illustrates a user manipulating a touchscreen device while wearing protector 10 of FIG. 1, in a preferred embodiment of the present invention.

As shown in FIG. 1, in a preferred embodiment of the present invention finger protector 10 is provided to protect a user's finger/digit 32 from directly touching or contacting a potentially contaminated surface or object. The protector 10 of the present invention has a wide range of useful applications. Notably, the protector 10 provides a barrier between a protected finger 32 and a potentially contaminated surface. Surfaces or objects which may become contaminated and transmit diseases and viruses when touched are frequently devices or objects which are touched or come into contact with many different people, and/or do so many times each day. Such devices may include keypads (FIG. 2) and touchscreens (FIG. 3) such as those found on ATMs, credit card machines, kiosks, gas pumps, computers, phones, copy and facsimile machines, point-of-sale terminals, access control pads, elevator control panels and other commonly-touched/used devices. Other commonly-touched surfaces or objects that may be contaminated include door handles and knobs, shopping carts, railings, pedestrian crossing buttons, thermostats, light switches, countertops, toilets, faucets and sinks, to name a few.

Preferably, protector 10 is made of a pliable, relatively impermeable material such as plastic or polypropylene, for example. Persons of ordinary skill in the art will understand that a wide variety of materials may be used while still providing the benefits of the invention of preventing the spread and transmission of diseases and viruses through contact or touch. Preferably the material of the protector is sufficiently flexible to permit easy insertion and removal of a finger into/from the protector 10 and for the protected finger 32 to be able to bend and manipulate an object or device while wearing the protector 10, while being sufficiently rigid to allow a user to grip an uncontaminated gripping portion 16 of the protector 10 to apply and remove the protector 10 from a user's finger. Furthermore, the material should be both sufficiently rigid and flexible so that the protector 10 may be easily dispensed from a dispenser device or packaging, including such as in the examples described herein. Preferably, the material is lightweight to make for cost efficient packaging and shipping. In preferred embodiments the protector 10 is disposable. Persons of ordinary skill will understand that although the protector is intended to be disposed of after one use, the protector 10 may be used multiple times while still providing the desired protection from contamination. In embodiments where a user is operating a touchscreen, the material of the protector preferably permits a user to operate controls on a device (such as the touchscreen, buttons, etc.) while wearing the protector 10. The protector may be made of a recyclable material and/or be biodegradable to reduce or eliminate the amount of waste created by used and disposed of protectors. Persons of ordinary skill in the art will appreciate that by providing a protector for covering a finger rather than a glove which covers a hand, the amount of material required to fabricate the device is significantly reduced, resulting in less waste and a smaller carbon footprint to make and use the device compared to gloves. In certain embodiments, the protector may be made of an antibacterial, antimicrobial, and/or antiviral material.

Figures 4A, 4B, 4C, 4D, 4E, 4F, 5:
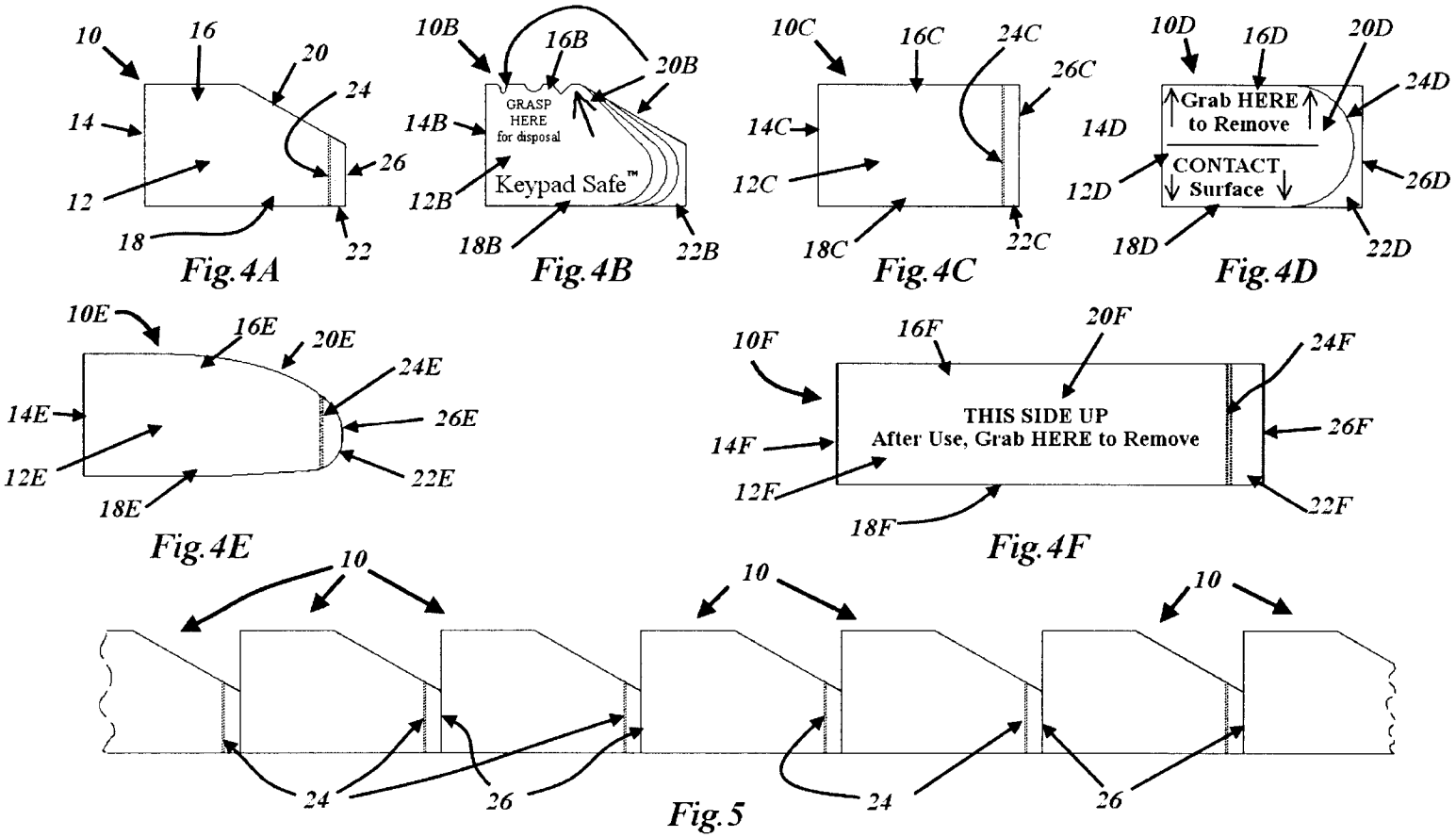
FIG. 4A is preferred embodiment of the finger protector 10 of the present invention.
FIG. 4B illustrates alternative embodiments of the protector of the present invention having indicia thereon for the indicating contacting and non-contacting surfaces of the device.
FIG. 4C illustrates another alternative embodiment of the protector of the present invention.
FIG. 4D illustrates a further alternate embodiment of the protector of the present invention having additional indicia thereon for indicating contacting and non-contacting surfaces of the device.
FIG. 4E illustrates yet another embodiment of the protector of the present invention.
FIG. 4F illustrates still another embodiment of the protector of the present invention.
FIG. 5 illustrates a preferred method of fabrication of the protector of the present invention, wherein a plurality of protectors 10 may be formed from a continuous feed of plastic sheets.

As shown in FIGS. 1 and 4A, in a preferred embodiment of the present invention, an assembled protector 10 is rectangular having one "corner" cut out to form a sloped edge 20. The protector 10 is formed by edges 14, 16, 18, 20 and 26. Bottom edge 18 is formed at the fold created by a sheet of material which is cut into a preferred protector-shaped pattern being folded over onto itself so that edges 14, 16, 20 and 26 each align with their respective edge. Edges 16, 20 and 26 are sealed at their peripheries to form closed sides of the protector 10. As shown in FIG. 5, in a preferred embodiment of the present invention, front edge 26 is formed when two adjacent sheets of protector material are separated from each other along a tear line defining separate protector portions. Preferably, front edge 26 is sealed at seal 24 to form end seal 22. In a preferred embodiment, rearward edge 14 is not sealed to permit a user to insert a finger into that "end" of the protector 10. Persons of ordinary skill in the art will understand that the precise pattern and dimensions (including relative dimensions, straight vs. curved, etc.) of those edges and/or the protectors 10 can be selected and designed in a wide variety of shapes and sizes, depending on the application, the materials, and other design considerations.

In a preferred embodiment, the bottom side at the fold forms a contacting surface 18 of the protector 10 where the protector makes contact with an object or surface being touched by the user's protected/covered finger 32. The contacting surface 18 therefore may potentially become contaminated by making contact with a contaminated surface. Preferably, however, the contacting surface 18 itself is never touched by a user's other fingers (or other body parts/surfaces), especially after the contacting surface 18 of the protector 10 has been used to contact/touch a potentially contaminated surface. In a preferred embodiment of the present invention, a gripping portion 16 is provided that is spaced away from the "contacting surface 18," Preferably, the gripping portion 16 remains uncontaminated, and can be used for a user to grip with their unused/unprotected fingers 40 to remove the potentially contaminated protector 10 after use, without having to touch or come into contact with the potentially contaminated contacting surface 18. Gripping portion 16 thus preferably provides a non-contacting surface/area which remain uncontaminated during and after use. Preferably, gripping portion 16 remains at the top of a user's finger 32 during use and never makes contact with potentially contaminated surfaces. This provides the user with a confirmable non-contacting (and therefore uncontaminated) portion with which to grip and hold onto the protector 10 when applying and/or removing the protector device. Preferably, even if surface 18 of the protector 10 becomes contaminated through contact with a contaminated surface, a user can still safely and carefully handle gripping portion 16 of the protector 10, without risk of touching the potentially contaminated contacting surface 18.

The indicia of the non-contaminated (non-contacting) surface 16 can be practiced in any of a wide variety of ways, including at least visual and/or physical indicia (or indicators or indications). In some of the embodiments shown in the drawings, a sloped edge 20 provides both a visual and physical indication of the non-contaminated portion 16 of the protector by which a user should use to handle the protector (in order to avoid contamination following use of the protector). The sloped edge 20 is an indicator for a user to grab the protector at the gripping portion 16 to avoid potential contamination. Sloped edge 20 also provides the protector 10 with a shape that more closely resembles an anatomical human finger, especially when a finger is bent during use. As a result, sloped edge 20 also can help prevent protector 10 from rolling or spinning around on a user's finger, and thus can allow non-contaminated gripping portion 16 to remain at the top/dorsal side of a user's finger during use, and thus remain uncontaminated. Thus, the protector will be more likely to stay in place during use, so that the gripping portion 16 will be less likely to "roll around the user's finger" and increase the risk of the user touching the potentially contaminated portion of the protector 10.

To even further ensure that the protector 10 does not undesirably rotate around a user's finger, additional temporary holding elements (not shown) can be provided. For example, adhesive can be provided on a portion of the "inside" of non-contacting surface 16, and pressed against the user's dorsal finger portion when the protector is first place onto the finger. Preferably, the adhesion is sufficiently strong to reduce the likelihood of any rotation of the protector 10 around the user's finger, but sufficiently light to permit ready removal of the protector from the user's finger without leaving any residue. Among the many alternative ways to provide such additional "holding" of the protector on the user's finger are a short piece of adhesive tape contacting both the surface 16 and the user's adjacent skin, or a similar strip or other shape having on it a temporary adhesive.

As shown in FIG. 4B, indicia may be provided as further visual and/or physical cues of contaminated and non-contaminated portions of the protector 10B and of gripping portions 16B which a user should use to grasp to avoid contamination during removal of a used protector 10B. As shown, indicia 20B may include further physical indicators to protector 10B in addition to or instead of sloped edge 20B, such as notches provided in gripping portion 16B, and may additionally include symbols/labels/etc. with pictures and/or words indicating where to grab the protector 10B. As shown in FIG. 4B in one of the many examples of indicia which may be used to indicate where to grab the protector 10B, the words "GRASP HERE for disposal" may be printed at the gripping portion 16B on the protector material. In this example, "Keypad Safe™" is printed at contacting surface 18B indicating the contaminated area of the protector 10B. Persons of ordinary skill in the art will appreciate that the types/styles/sizes/shapes/colors/etc. of indicia to indicate contaminated and non-contaminated portions of the protector 10B are virtually limitless and the disclosures herein are only presented by way of example and should not be construed as limiting the inventive concept to any particular physical configuration.

As further shown in FIGS. 4B through 4F, protectors may be provided in a multitude of shapes and sizes, some of which are discussed herein. In FIG. 4B, the front edge of protector 10B may be rounded between the gripping portion 16B and contacting surface 18B. In this embodiment, the front edge may be rounded to correspond more closely to the anatomical shape of a human fingertip, and the degree of rounding may depend on a number of factors, including the intended use of the device, the material properties of the protector, and the normal or average size of a human fingertip, to name a few. In FIG. 4B, a few of the many variations of a protector 10B having a rounded front edge or "tip" are shown.

FIG. 4C shows a rectangular protector 10C without a sloped edge (shown in FIGS. 4A and 4B). Persons of ordinary skill will appreciate that while a rectangular protector 10C embodiment may not provide the same benefits that having at least one sloped edge provides (a visual indicator of a non contaminated gripping portion and preventing the protector from rolling around a user's finger), it may provide other benefits such as reduced fabrication costs, for example.

FIG. 4D illustrates a both a rectangular protector 10D and a protector having a rounded front/tip portion with indicia thereon to indicate a non contaminated gripping portion and a contaminated contacting surface. As shown, the top portion of the protector 10D has the words "Grab HERE to Remove" and upwards pointing arrows printed thereon to indicate a gripping portion of the protector 10D, and "CONTACT Surface" and downwards pointing arrows printed on a bottom surface of the protector 10D to indicate a contacting surface (i.e., potentially contaminated after use) of the protector. FIG. 4E illustrates another alternative embodiment of the invention being shaped to closely correspond to the anatomical shape of a human finger, having a relatively flat bottom/"palmar" surface and a rounded upper/"dorsal" surface with a rounded "tip". FIG. 4F illustrates yet another embodiment of the present invention wherein during use a user's finger is oriented in the protector 10F such that the top/dorsal surface of their finger corresponds with a top surface of the protector 10F and the bottom/palmar surface of their finger corresponds with a bottom surface of the protector (instead of a user's finger being oriented such that edges (16, 16B/18, 18B) correspond with the top and bottom surfaces of their fingers, respectively—FIGS. 4A through 4D). In this embodiment, the top surface of the protector 10F has indicia/printing thereon which instructs a user "THIS SIDE UP. After Use, Grab HERE to Remove" so that a user knows where to grab the uncontaminated portion of the protector 10F after use.

The protector or protectors can be fabricated from any suitable materials and via any suitable method. Mass production is preferred, to provide speed and efficiency in production and packaging and processing. A preferred method of fabrication is illustrated in FIG. 5, showing a plurality of protectors 10 such as may be formed from a continuous feed of clear plastic or polypropylene tubing provided on rollers. This type of packaging has been used as packages/bags for small items such as earrings. Depending on the particular application or embodiment of the present inventions, that feedstock can be used "as is", or modified as further discussed herein to provide visual and/or physical indicia permitting a user to track the "contaminated" contact surface of the protector (the protector area/surface that has contacted the potentially contaminated touchpad or other object).

The example of FIG. 5 uses extruded tubular feedstock, but persons of ordinary skill in the art will appreciate that there are virtually unlimited ways in which the protectors may be made. In this example, tear lines are provided between adjacent tubular "sheets" of protectors 10 and form front edges 26 of protectors 10 when two adjacent sheets of protector material are separated from each other along the tear line(s). One or more sealing/cutting/forming/laser/ultrasonic dies (not shown) may be configured to press/melt/other the tear lines forming front edges 26, seal lines 24 and other edges shown in FIG. 5. Preferably, sloped edge (20, as shown in FIG. 4A) is formed by die cutting or other cutting techniques known to those skilled in the art to cut out a triangular section of the upper right corner (when viewed as in FIG. 5) of each protector "sheet". Preferably, when the "sheets" are separated from each other along the tear lines, they are individually folded into the preferred protector configuration and sealed along their edges, leaving the rearward edge unsealed and open to permit a user to insert a finger into that "end" of the protector.

Figure 6A:
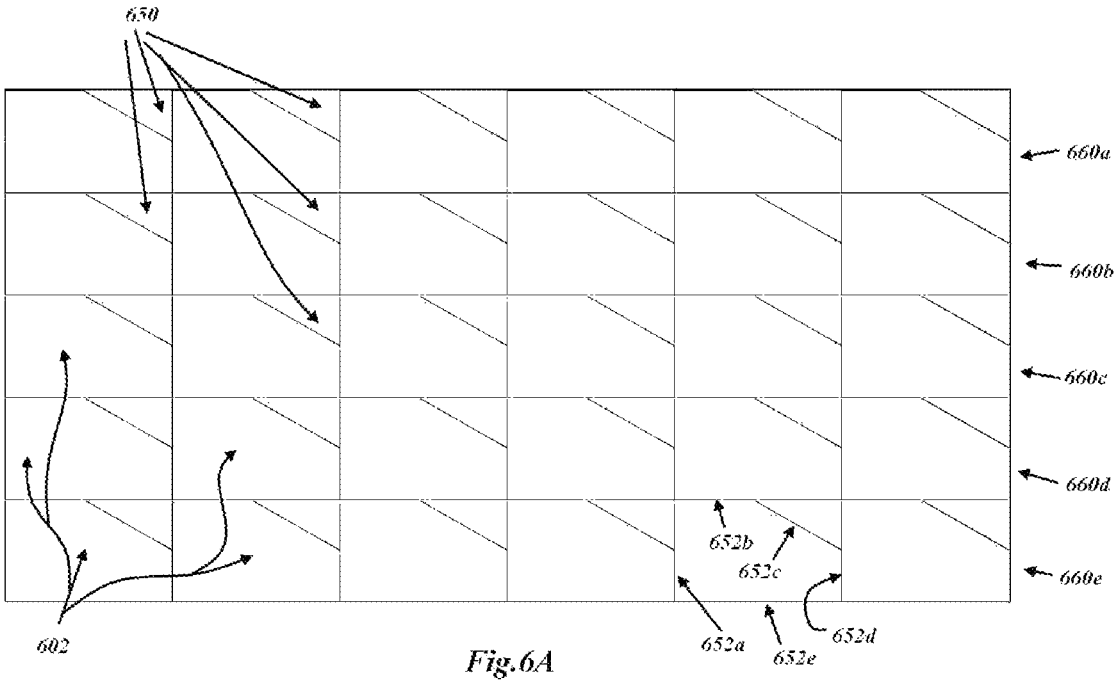
FIG. 6A illustrates one of the many examples of mass production of the present invention, wherein a plurality of protectors may be formed from two overlaying sheets of plastic or similar material.
Figure 6B:
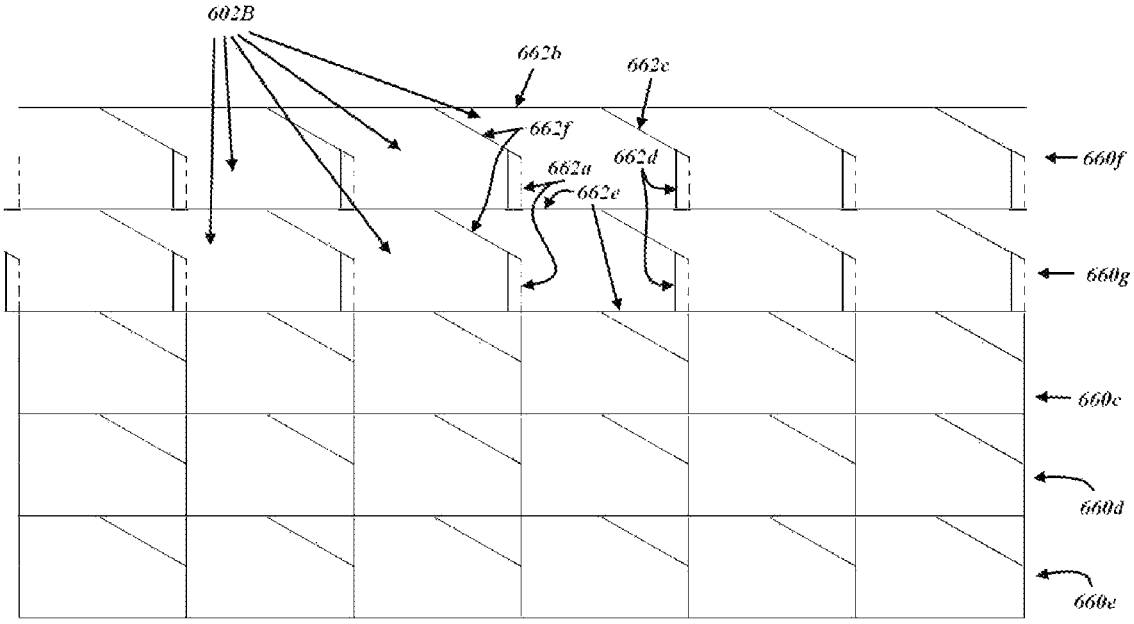
FIG. 6B is similar to FIG. 6A, but illustrates one of the many different cut/seal/forming patterns that can be used for the dies/lasers/other tools forming the protectors of the present invention.

Some of the many alternative examples of mass production are illustrated in FIGS. 6A and 6B, showing a plurality of protectors 602 such as may be formed from two overlaying sheets of plastic or similar material. One or more sealing/cutting/forming/laser/ultrasonic dies (not shown) may be configured to press/melt/other the lines shown in FIGS. 6A and 6B, thereby forming the protectors 602. For the embodiments of FIG. 6A, the protector is formed with edges 652*a*, 652*b*, 652*c*, 652*d*, and 652*e*. Persons of ordinary skill in the art will understand that the precise pattern and dimensions (including relative dimensions, straight vs. curved, etc.) of those edges and/or the protectors 602 can be selected and designed in a wide variety of shapes and sizes, depending on the application, the materials, and other design considerations. The rearward edge 652*a* preferably is not sealed, to permit the user to insert a finger into that "end" of the protector 602. For the embodiments of FIGS. 6A and 6B, a triangle 650 is formed, and may be waste material that is left behind after the forming step (for recycling or other uses), or may remain attached to the adjacent protector 602 along their shared seal line 652*c* (in embodiments in which line 652*c* is "just" a seal line rather than a cut/seal line.

FIG. 6B is similar to FIG. 6A, but illustrates one of the many different cut/seal/forming patterns that can be used for the dies/lasers/other tools forming the protectors 602. One or more of the protectors 602 (and/or the entire rows 660*a-e* of protectors 602) may be formed with a pattern different than the others. In FIG. 6B, this is shown as the exemplary rows 660*f* and 660*g* in place of rows 660*a-b* in FIG. 6A. Rows 660*f-g* include protectors that can be somewhat similar to protectors 602 in FIG. 6A, but which have a different pattern seal/tearline formed in the vertical direction when viewed as in FIG. 6B. Rather than a continuous cut/tearline/seal across the entire die (such as lines 652*a* across the rows 660*a-e* in FIG. 6A), the rows 660*f-g* in FIG. 6B have a "seal" line 662*d* moved leftward (as viewed in the drawings, and as compared to line 652*d* in FIG. 6A) and a tearline 662*a* formed in its place. In addition, that tearline 662*a* does not extend upwardly (as viewed in the drawings) beyond the cut/seal line 662*c*. As a consequence, the "triangle" waste portions 650 in FIG. 6A instead remain part of the protector itself, and in fact can serve as yet another indicia of the portion of the protector that a user should use to handle the protector (in order to avoid contamination following use of the protector).

Thus, in embodiments such as shown in FIG. 6B, the bottom three rows 660*c-e* can be identical to ones formed via those corresponding rows in FIG. 6A, but the upper two rows in the embodiment of FIG. 6B can provide a "strip" of connected protectors, that can be packaged (in roll or other form) in their still-attached condition so that users can "tear" one or more from the strip just prior to use. By providing the die pattern of FIG. 6B on a cylinder die or stamping die, the feedstock and resulting products can be formed via a virtually continuous feed of input material.

Figure 7A:
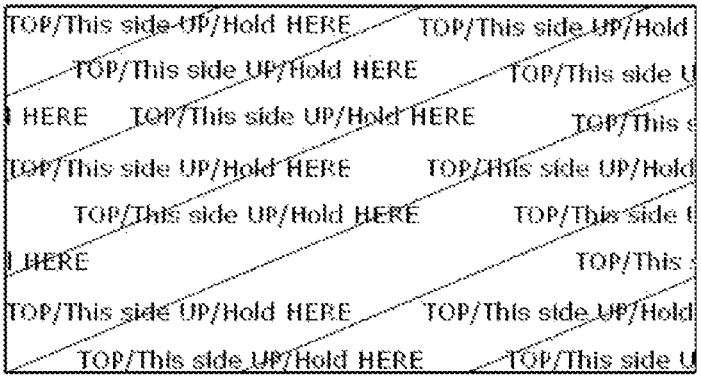
FIGS. 7A-C illustrate some of the many types of indicia that can be used in various embodiments of the invention.
Figure 7B:
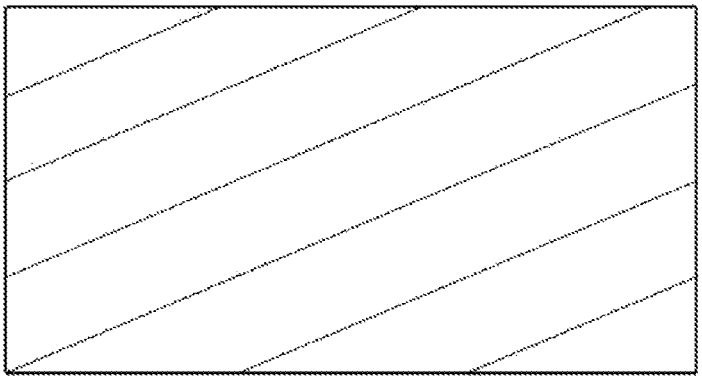
Figure 7C:
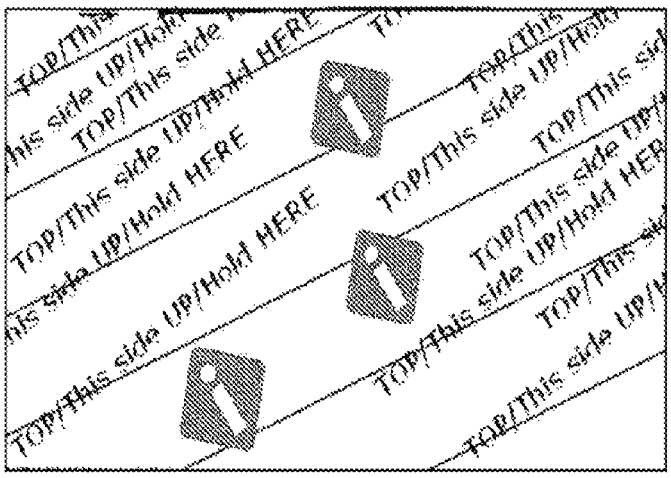

FIGS. 7A-C illustrate some of the many types of indicia that can be used in various embodiments of the invention. Persons of ordinary skill in the art will understand that any visual marking or coloring or pattern can be used. In the examples shown, FIG. 7A has text and diagonal stripes, FIG. 7B has only diagonal stripes, and FIG. 7C has text and diagonal stripes and symbols. Persons of ordinary skill in the art will understand that such indicia may be printed or otherwise provided on sheets, rolls, or other feedstock from which the protectors may be fabricated, with a clear or different feedstock for a second/other/bottom layer (not shown in FIGS. 7A-C). The visual contrast between the visual indicia of FIGS. 7A-C and the "other" side of the protector will enable a user to touch only one (hopefully uncontaminated) side of the protector, especially following use of the protector.

Figures 8A, 8B:
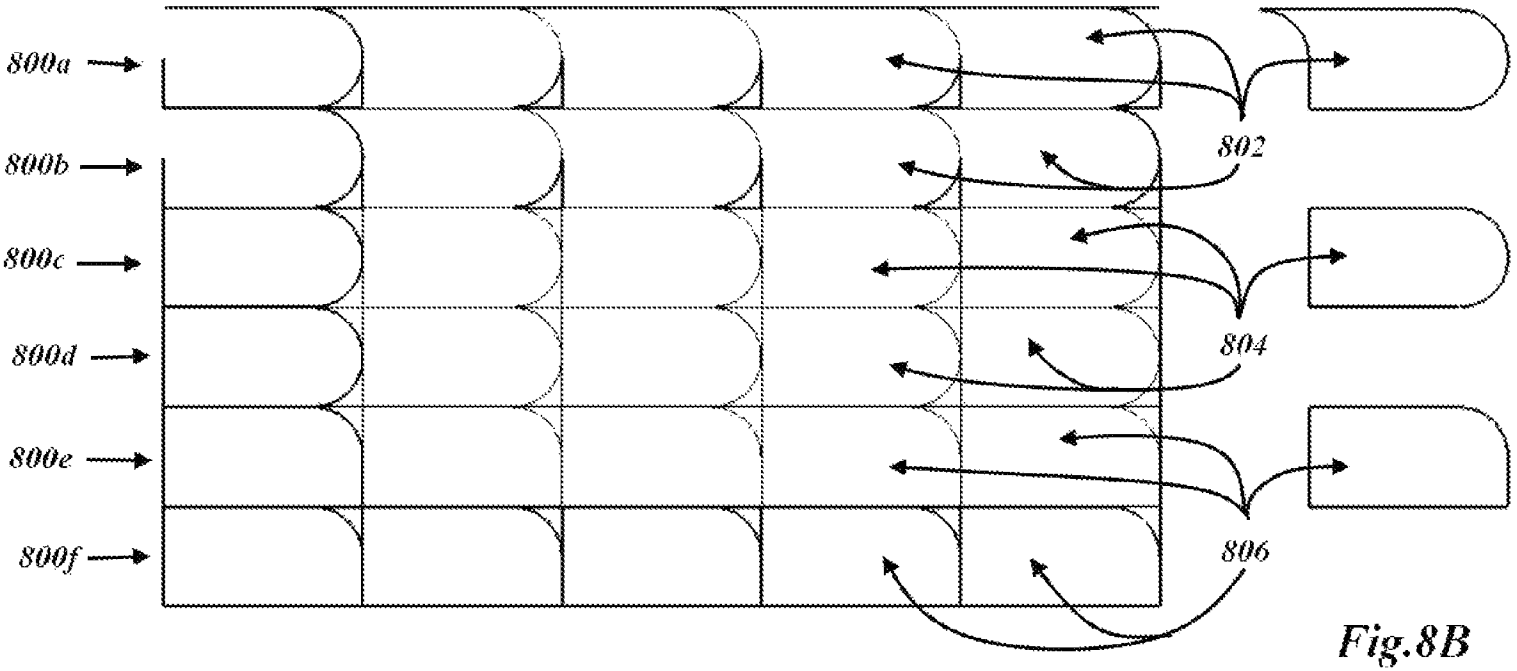
FIGS. 8A and 8B illustrate some of the many embodiments of die/seal/protector patterns that may be used to practice the invention.

FIGS. 8A and 8B illustrate some of the many embodiments of die/seal/protector patterns that may be used to practice the invention. FIG. 8B illustrates the three separate patterns 802/804/806 (set to the right of FIG. 8A), and FIG. 8A illustrates a die/pattern/sheet by which all three of those patterns 802/804/806 may be included within a single die/cutting shape/etc.

In the embodiment of FIG. 8A, six rows 800*a-f* of protector shapes/patterns 802/804/806 are shown, with five protectors formed in each row. Persons of ordinary skill in the art will understand that, among the many alternative methods of fabricating protectors of the invention, a single pattern/shape could instead be formed over the entire group shown in FIG. 8A.

Each of those shapes/patterns 802/804/806 is illustrated as being formed in two of the six rows—shape 802 is formed in rows 800*a-b*, shape 804 is formed in rows 800*c-d*, and shape 806 is formed in rows 800*e-f*. In those embodiments, shape 804 is shown as having "mirror image" top and bottom halves, while shapes 802 and 806 have non-mirrored top and bottom edge shapes that provide visual and tactile indicia that can be used to help orient and guide a user to grab non-contaminated surfaces of the protector following use. As with virtually any embodiment of the invention, labels/text/colors/printing or other indicia also can be used on any of the patterns 802/804/806, to assist a user in that regard.

Persons of ordinary skill will understand that the number of rows and protectors per row, the shape/s, materials used, fabrication methods used, and virtually all other aspects of the protectors, the die/seal/cutting patterns, and/or other fabrication processes can be modified to address specific applications, safety, and other design criteria.

Figure 9A:
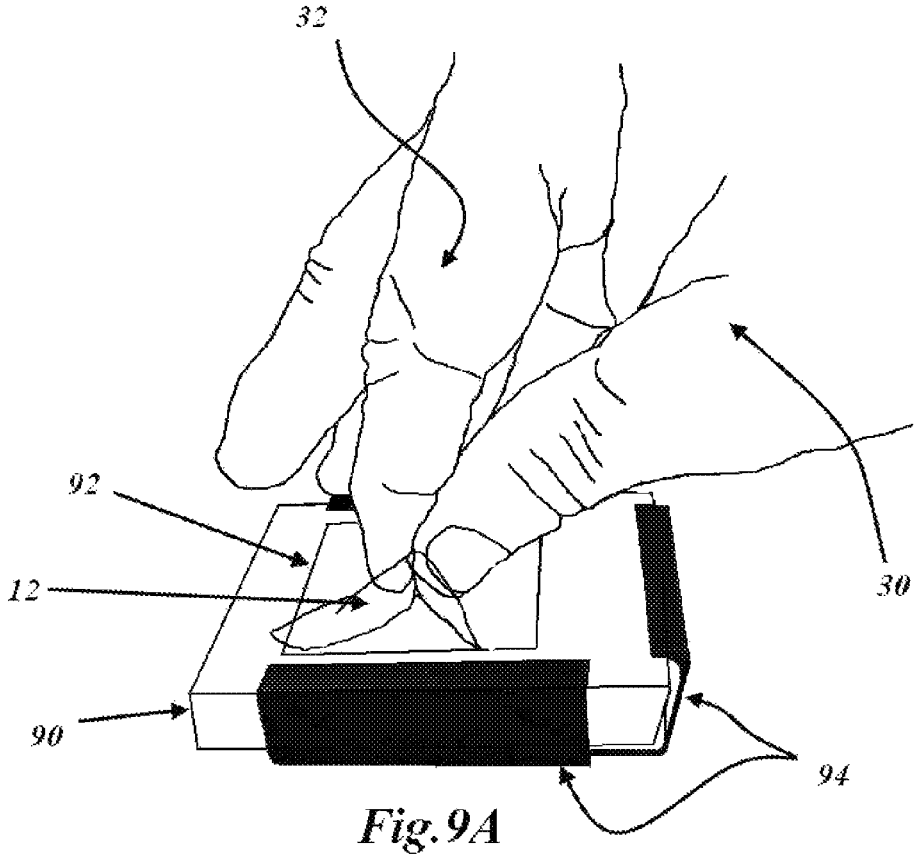
FIGS. 9A-B illustrate one of the many ways in which protectors of the invention may be packaged and dispensed to end users.
Figure 9B:
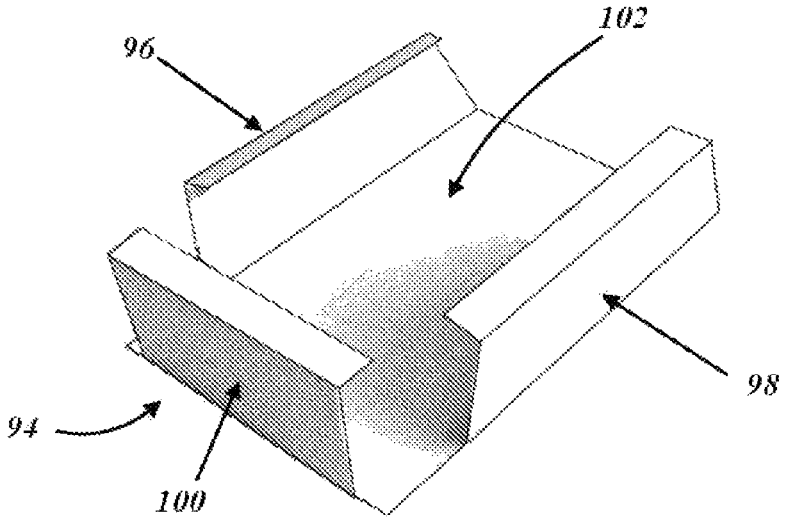

FIGS. 9A-B illustrate one of the many ways in which protectors of the invention may be packaged and dispensed to end users. A box 90 having an opening 92 preferably contains a plurality of protectors 12. Preferably, a user may use the user's hand 30 (including digits such as finger 32) to grasp the topmost protector 90 through the opening 92, pinch or otherwise remove the protector from the box 90 through that opening 92, and then use it in any desired manner (for example, see FIGS. 1-3). A bracket or holder 94 may be provided to temporarily hold the dispensing box 90 at a desired location, and when the box 90 is empty, it may be removed and a replacement full box (not shown) of protectors 12 may be placed into the holder 94. Among many examples, such a holder or holders 94 may be mounted or adhered in any suitable manner adjacent a keypad or control pad of an ATM, copy machine, checkout payment device, etc.

Persons of ordinary skill will understand that the shape and dimensions of a container or box 90, its dispense opening 92, and a holding bracket 94 may be any of a wide variety, and can be designed for the particular application and intended and expected use of the inventions. For embodiments such as illustrated in FIGS. 9A and 9B, the dimensions and shapes of those components 90, 92, and 94 preferably correlate with each other, to facilitate the ready access and dispense of protectors 12 to users, and the ready replacement of new boxes 90 into holder 94 when a given box 90 has been emptied of protectors 12. In FIG. 9B, the holder/bracket 94 is illustrated as having opposing side guides 96 and 98 and an end stop 100. Each of the side guides 96 and 98 and the end stop 100 preferably include an upper lip extending toward the center of the bracket 94, to help retain the box 90 in a desired position within the holder 94. Boxes such as box 90 preferably can be readily inserted and removed by sliding the boxes 90 in/out of the open end opposite stop 100. The holder 94 can be adhered to a mating surface by providing adhesive on the underside of bottom 102, fastening the holder in a desired location via screws, nails, or the like, or any other suitable means.

Persons of ordinary skill also will understand that the protectors 12 may be interleaved (such as in a box of facial tissues, so that pulling one protector "pops up" the one below it), folded with tear lines so that the user tears their protector from a "connected strip" of protectors (such as illustrated in rows 660*f-g* in FIG. 6B) that is folded inside the box 90, may simply be separate protectors 12 that are stacked on top of each other within the box 90, or may be configured in any of a wide variety of other packaging arrangements. Depending on the material from which the protectors 12 are fabricated and other factors, they may be too "slick" to work well in an interleaved configuration.

Figure 10A:
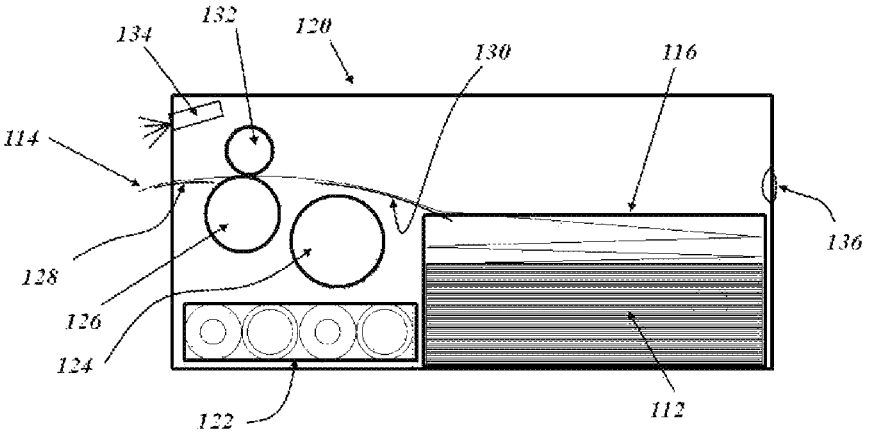
FIGS. 10A and 10B illustrate some of the many other embodiments of the invention, including some of the many ways in which continuous strips of protectors 112 may be used to distribute one or more individual protectors to users.
Figure 10B:
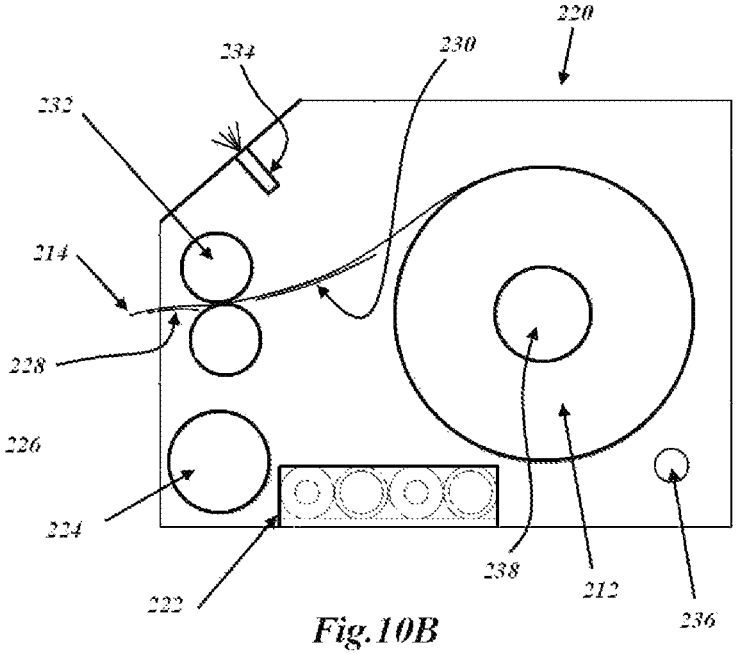

FIGS. 10A and 10B illustrate some of the many other embodiments of the invention, including some of the many ways in which continuous strips of protectors 112 may be used to distribute one or more individual protectors to users. In FIG. 10A, an automatic dispenser 120 preferably is similar in operation to a paper towel dispenser. Dispenser 120 preferably includes a power source 122, which can be an external power source or onboard source such as one or more batteries. That power source drives the relevant components of the dispenser 120, including a motor 124 that controls rotation of a drive wheel 126 in response to a motion sensor 134. A tension wheel 132 holds the strip 112 in a desired position engaging the drive wheel 126, and controlled rotation of drive wheel 126 thrusts the end 114 of the strip 112 out toward a user, who can then tear it off of the remaining strip inside the dispenser 120. Access means 136 permits replacement of strip stock 112 and/or other components. Strip stock 112 preferably is contained inside dispenser 120 in a tray 116, and strip 112 is pulled from its preferably folded condition over guides 128 and 130 to be dispensed to the user.

FIG. 10B is similar to FIG. 10A, but illustrates a spool or roll 212 of continuously-connected protectors 212, mounted on a spindle 238 in an automatic dispenser 220. The other components in FIG. 10B are numbered to correspond to those in FIG. 10A, and have similar preferred functions and relationships. Persons of ordinary skill in the art will understand that some of the many other embodiments of the inventions, not shown, include ones similar to those shown in FIGS. 10*a* and 10B, but without any "automated" feed mechanism. Instead, a tearing edge or detent may be provided near the dispense point, and a user may grasp the end of the strip 112/212 and manually pull a desired number of protectors out of the front of the dispenser 120/220, and then tear the protector/s from the remaining strip 112/212.

Any of a wide range of containers and packaging and distribution can be used to practice the invention. These include, by way of further examples and not by way of limitation, a "personal pack" of a few protectors in a sealed wrapper (like a small quantity of wipes or facial tissues), and top-feed containers (similar to those for dispensing antibacterial wipes, with a pop-up lid that covers a small opening, and a string of connected protectors that can be fed through that opening and "grabbed" by surrounding teeth to be held in place, awaiting a user to remove one protector and tear it from the string while simultaneously manually pulling up the "string" of connected protectors so that the next protector is positioned for subsequent removal).

For the purpose of summarizing the invention, certain objects and advantages have been described herein. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The apparatus and methods of the invention have been described with some particularity, but the specific designs, constructions, and steps disclosed are not to be taken as delimiting of the invention. A wide range of modifications and alternative structures and steps for practicing the invention will make themselves apparent to those of ordinary skill in the art, all of which will not depart from the essence of the invention, and all such changes and modifications are intended to be encompassed within the appended claims.

What is claimed is:

1. A lightweight disposable sleeve:

said sleeve having a generally rectangular shape when in a collapsed condition prior to use, said sleeve in said collapsed condition having a front edge, a rearward edge, a top edge, a bottom edge and a sloped edge extending between said front edge and top edge, said front edge, sloped edge, top edge and bottom edge being sealed at their respective peripheries, and said rearward edge defining an opening for inserting a user's digit into said sleeve, said sleeve sized and configured to cover the end and at least a portion of a user's finger, said sleeve having indicia thereon indicating to a user an area and/or areas of said sleeve that is to be positioned toward and/or away from contact with any contaminated surface.

2. Apparatus for protecting a user's digit from contact with a contaminated surface, including:

a protector pouch sized and configured to be readily placed on a user's digit and comfortably remain on that digit during use;

an opening provided in said protector at a rearmost edge of said pouch for inserting a user's digit into said pouch;

said protector having an underside defining a contacting surface for contacting a potentially contaminated surface;

said protector having an upper surface defining a gripping portion which is spaced from said contacting surface, said gripping portion sized and shaped and positioned to be gripped at said gripping portion by one or more digits from a user's second hand, whereby the user can manipulate said protector without touching said contacting surface.

3. The apparatus of claim 2, further including indicia provided on said protector to indicate to the user the location of said contacting surface and/or the location of said gripping portion.

4. The lightweight disposable sleeve of claim 1, wherein the lightweight disposable sleeve is formed as part of an extended strip containing a plurality of said lightweight disposable sleeves with tearlines separating said plurality of sleeves from adjacent sleeves, by which a user may select one or more of said plurality of said lightweight disposable sleeves and tear them from said strip.

5. A method of protecting a user's digit from contact with a contaminated surface, including the steps of:

providing a sleeve of claim 1;

inserting a user's digit into said opening thereby making said digit a covered digit;

contacting a potentially contaminated surface with a portion of said protector covering said digit;

thereafter gripping a different portion of said protector covering using one or more other digits from the user's second hand;

removing said protector from the user's covered digit without touching said portion of said protector that contacted said potentially contaminated surface.

6. The apparatus of claim 2, wherein the protector is made of a material that is pliable and impermeable.

* * * * *